United States Patent [19]

Newton

[11] 4,445,916

[45] May 1, 1984

[54] PROCESS FOR LIQUEFYING METHANE

[76] Inventor: Charles L. Newton, 3 Highland Ct., R.D. #7, Bethlehem, Pa. 18015

[21] Appl. No.: 412,686

[22] Filed: Aug. 30, 1982

[51] Int. Cl.[3] ..... F25J 3/02

[52] U.S. Cl. ..... 62/17; 62/38; 62/40

[58] Field of Search ..... 55/27, 25, 44, 55, 57, 55/48, 68, 73; 62/9, 11, 23, 24, 31, 40, 38, 39, 17, 20

[56] References Cited

U.S. PATENT DOCUMENTS

| | | | |
|---|---|---|---|
| 3,292,380 | 12/1966 | Bucklin | 62/20 |
| 4,004,430 | 1/1977 | Solomon et al. | 62/18 |
| 4,061,481 | 12/1977 | Campbell et al. | 62/29 |
| 4,065,278 | 12/1977 | Newton et al. | 62/26 |
| 4,203,741 | 5/1980 | Bellinger et al. | 62/24 |

OTHER PUBLICATIONS

R. D. Parker, "Cryogenic Processing . . . Mobil", Mar. 1972, Technology, Natural Gas Processors Assn.

J. G. Gulsby, Mar. 1979, "Options for Ethane Rejection in the Cryogenic Expander Plant," 58 Annual GPA Convention.

*Primary Examiner*—Frank Sever

*Attorney, Agent, or Firm*—Geoffrey L. Chase; E. Eugene Innis; James C. Simmons

[57] ABSTRACT

A process for liquefying natural gas in which heavier hydrocarbons are separated in a scrub column from the natural gas prior to liquefaction. The feed to the scrub column is intercooled against the methane-rich overhead from said column and isentropically expanded before being introduced to the column and separated from the heavier hydrocarbons. The methane-rich overhead stream is compressed utilizing the mechanical energy of expansion and liquefied in a refrigerated heat exchanger.

7 Claims, 4 Drawing Figures

PROCESS FOR LIQUEFYING METHANE

TECHNICAL FIELD

The present invention is directed to a process for liquefying methane-rich gas streams, such as natural gas. The present invention is also directed to the separation and removal of heavier hydrocarbons from the methane-rich feedstocks prior to liquefaction of the gas stream. The present invention is specifically related to the more efficient recovery and utilization of refrigeration in the processing of the methane-rich feedstocks.

BACKGROUND OF THE PRIOR ART

Natural gas and other methane-rich feedstocks are frequently produced in regions distant from the location where such fuels will be finally utilized. The problem of transportation of natural gas from remote production sites to other sites of utilization is particularly acute when the natural gas must be shipped overseas. In such instances, absent a pipeline, the costs of transportation require that the natural gas be liquefied. The liquefaction of natural gas is energy intensive and systems for performing this liquefaction must be extremely efficient in order to maintain the competitive economics of natural gas as fuel being transported over significant distances. Various processes for the liquefaction of natural gas or the separation of natural gas liquids, i.e. hydrocarbons heavier than methane, have been set forth in the prior art.

In U.S. Pat. No. 3,292,380, a process for removing condensibles from a hydrocarbon gas stream is set forth in which the feedstock is heat exchanged against the overhead from a distillation column before being separated into gas and liquid phases, the gas phase of which is expanded in a turbine and delivered to the distillation column. A portion of the liquid phase is also supplied to the column. An overhead gas phase which is not liquefied is drawn off from the distillation column and a heavier hydrocarbon such as ethane and LPG is drawn off as a bottom stream from the column. This patent is directed only to the removal of condensibles and not to the liquefaction of natural gas.

U.S. Pat. No. 4,004,430 also discloses a process for removing natural gas liquids from a methane-rich stream. The methane-rich gaseous product is separated from the natural gas liquids product in a cryogenic distillation column. Again, the methane-rich product is not liquefied.

In U.S. Pat. No. 4,061,481, a process is disclosed for the separation of condensible hydrocarbon liquids from gaseous hydrocarbon components in a distillation column. The feedstock is heat exchanged against the overhead of the distillation column prior to and after being expanded to a lower pressure. Liquefaction of the overhead methane-rich stream from the distillation column is not set forth.

U.S. Pat. No. 4,065,278, having the same assignee as the present invention, is directed to a natural gas liquefaction process wherein condensible higher hydrocarbons are removed from the natural gas stream prior to liquefaction of the methane-rich gas. In this patent, an additional heat exchange bundle is utilized to provide the initial cooling of the methane-rich overhead from a distillation column wherein the additional heat exchange bundle utilizes a low temperature refrigeration.

U.S. Pat. No. 4,203,741 discloses a separator system for hydrocarbon gas feed streams. The feed stream is split into a plurality of feeds to a separation or distillation column. One of the feed streams is expanded and heat exchanged against the overhead from the column. The process produces natural gas liquids and a vapor product which may be methane-rich.

In a paper presented at the 58th annual GPA convention on Mar. 19 through 21, 1979 at Denver, Colo. titled OPTIONS FOR ETHANE REJECTION IN THE CRYOGENIC EXPANDER PLANT, by Jerry G. Gulsby, an ethane rejection plant is set forth in which a hydrocarbon inlet gas is heat exchanged against a demethanizer column overhead stream and expanded before being introduced into the demethanizer. The overhead stream from the demethanizer is recompressed but is not liquified.

In another article appearing in the Oil and Gas Journal of Mar. 13, 1972 titled CRYOGENIC PROCESSING HAS WORKED FOR MOBIL by R. D. Parker, a cryogenic system for separating hydrocarbons heavier than methane from methane is set forth in which the heavier hydrocarbons are liquified. The methane fraction of the feed gas being treated is not liquefied. At least a portion of the feed to the demethanizer column is exchanged against an overhead stream from such column.

The prior art fails to disclose the advantage of the present invention wherein a natural gas liquefaction process is provided with expanded feed being added to the top of the scrub column at relatively high pressure and the methane-rich overhead is liquefied in a two bundle heat exchanger in an efficient manner, wherein liquid feed or reflux to the column is provided by refrigeration power from a high level refrigerant and the isentropic expansion of the feed and not by low level refrigeration.

The prior art also fails to disclose another advantage of the present invention wherein in a combined separation and liquefaction process for natural gas streams in which heavier hydrocarbons are separated from natural gas before the methane-rich natural gas is liquefied, the methane-rich overhead from the separatory or scrub column is heat exchanged in an intercooler against the feed stream being introduced into the column. This provides for increased efficiency of operation of a system wherein natural gas liquid recovery and methane liquefaction are combined.

BRIEF SUMMARY OF THE INVENTION

The present invention comprises an efficient process for the liquefaction of a methane-rich hydrocarbon gas feedstock, such as natural gas. The feedstock, at 600–2000 psia is cooled by heat exchange against a first refrigerant. The cooled feedstock is reduced in pressure below the critical pressure of the feedstock by isentropic expansion while obtaining mechanical energy. The expanded stream, still at relatively high pressure, is introduced into the top of a scrub column, wherein a minor amount of heavy hydrocarbons are removed as makeup refrigerant as a bottom stream and a methane-rich fraction is removed as an overhead stream. The methane-rich fraction is recompressed to a high pressure by a compressor utilizing the mechanical energy derived from the isentropic expansion. The compressed methane is then cooled, liquefied and subcooled by heat exchange against a second, multi-component refrigerant in a two bundle heat exchanger. The subcooled liquid product is then removed as an LNG product.

A second embodiment of the present invention comprises a process for the separation of heavier hydrocarbons from methane and the liquefaction of the methane from a methane-rich hydrocarbon gas feedstock, such as natural gas. In the process, the feedstock is first cooled by heat exchange against a first refrigerant before the feedstock is reduced in pressure by a combination of isentropic expansion and intercooling by heat exchange with the overhead from a separator or scrub column. In the column, the feedstock is separated into a methane-rich gas overhead stream and a heavier hydrocarbon liquid bottom stream. The overhead stream is warmed by heat exchange with the feedstock prior to being compressed in a compressor driven by the energy derived from the expander of the isentropic expansion step. The compressed methane-rich overhead stream is then cooled, liquefied and subcooled in a main heat exchanger against a second low level refrigerant.

In one version of the second embodiment, the reduction in pressure of the feedstock is achieved by first isentropically expanding the feed through an expander and then cooling it by heat exchange in an intercooler with the overhead stream before being introduced to the column.

In an alternate version of the second embodiment, the feedstock is first cooled by an intercooling heat exchange with the overhead stream from the column before the intercooled feedstock is then isentropically expanded and the expanded feedstock introduced into the column.

At lower pressures, the feedstock can be first phase separated to provide a liquid feed to the column enriched in heavy hydrocarbons while the vapor phase is cooled by an intercooling heat exchange with the overhead from said column before being further phase separated. The liquid phase is supplied directly to the column while the vapor phase is isentropically expanded and partially liquefied and supplied to the column overhead where the liquid is used as column reflux. This triple feed increases the performance efficiency of the column in performing a separation of the methane fraction from the heavier hydrocarbon fraction of the feedstock.

The advantage of the various embodiments of the present invention over the prior art, such as U.S. Pat. No. 4,065,278, is that a reduction in the number of heat exchange bundles in the liquefying main heat exchanger can be made at significant reduction in capital expenditure.

A second advantage of the present invention is the use of predominantly isentropic expansion of the feed stream to provide the refrigeration power necessary for the production of liquid feed or reflux to the scrub column. The refrigeration power is assisted by the initial cooling of the feed with high level refrigeration by the invention avoids the use of expensive low level refrigeration to provide reflux.

Another advantage of the second embodiment of the present invention is the use of an intercooling heat exchanger which improves the operation of the scrub column and avoids the use of expensive low level refrigeration from the main heat exchanger, which liquefies methane to cool the feed to the scrub column.

A further advantage of the second embodiment of the present invention resides in the use of high level refrigeration to cool the compressed overhead stream from the scrub column to further decrease the demands on the expensive low level refrigeration in the main heat exchanger used to liquefy the methane.

Utilizing the advantages listed above allows the present invention to operate with significant power efficiencies over the prior art. These efficiencies range from 3.2% to 8.8% improvement over the prior art based upon refrigeration compressor horse power demands for a mole per hour of LNG production and the particular embodiment being considered.

DETAILED DESCRIPTION OF THE INVENTION

The various embodiments of the present invention will now be described in greater detail. The general flowscheme is similar to that in U.S. Pat. No. 4,065,278, commonly assigned, and that disclosure is hereby incorporated by reference. The hydrocarbon feedstocks which are amenable to processing in the processes of the present invention generally consist of natural gas or other methane-containing gas streams wherein the methane content is from 60 to about 90 mole % of the feed gas stream and the balance is comprised of nitrogen and heavier hydrocarbons such as ethane, propane and longer hydrocarbon chain molecules. The present invention separates the methane-rich fraction of the feed stream from at least some of the heavier hydrocarbon fraction in order that the methane-rich fraction may be liquefied for transportation and subsequent fuel use, while the heavier hydrocarbons are condensed and can be utilized without refrigeration input as fuels or refrigerants themselves.

Figure 1A:
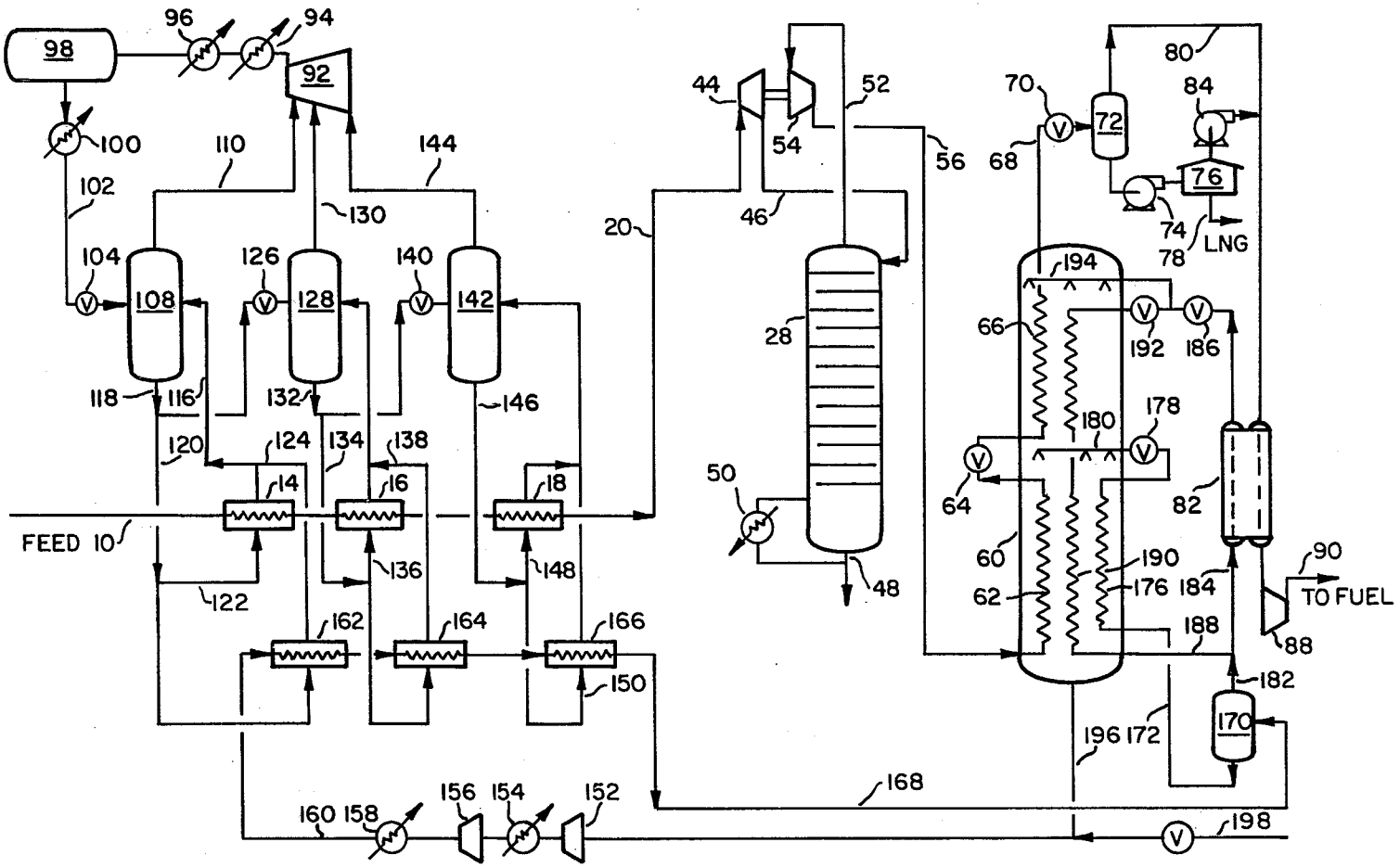
FIG. 1A is a schematic diagram of a first preferred embodiment of the present invention for utilization on medium pressure natural gas streams.

With reference to FIG. 1A, a natural gas feed stream of high pressure (1000 to 2000 psia) can be processed in the flow scheme shown in this drawing. A typical feed at 1431 psia consists of methane 93%, ethane 4%, propane 0.6%, butane 0.3%, isobutane 0.1%, nitrogen 0.8% and trace amounts of higher hydrocarbons and water. The feed stream in line 10 is initially cooled to −34° F. through a series of cascade heat exchangers 14, 16 and 18 which are cooled by a closed circuit refrigerant system. The refrigerant is generally a single component hydrocarbon such as $C_2$, $C_3$ or $C_4$ paraffin hydrocarbons. Propane is the preferred single component refrigerant used in this first closed cycle refrigeration system because of its refrigeration duty at the operational temperature and pressure and because it can be provided from the separated natural gas liquids for makeup. This closed circuit refrigeration system constitutes a high level refrigerant because it is at a relatively warm temperature for a process involving the liquefaction of natural gas. In light of its relatively warm temperature, high level refrigerant is relatively less expensive to use than lower level refrigerants. The precooled high pressure feed is introduced by way of line 20 into an expander turbine 44 where it is reduced in pressure to 725 psia at −88° F. while producing mechanical energy. The expanded feed containing vapor and liquid in line 46 is introduced into the top of the scrub column 28. The feed to the top of the scrub column provides for sufficient fractionation of the methane-rich fraction from the heavier hydrocarbon fraction of the feedstock to provide makeup refrigerant. The scrub column 28 is operated at approximately 725 psia. The heavier hydrocarbons are removed from the scrub column 28 in line 48 and a portion of the heavier hydrocarbons are recycled through reboiling heat exchanger 50 in order to provide reboil for the column. The remainder of the bottom stream in line 48 is removed as product known generally as NGL or natural gas liquids. For the stated feed stream composition, the composition of the heavier hydrocarbons consist of 34.7% ethane, 17.8% propane, 13.5% butane, 4% isobutane, and residual amounts of pentane, isopentane and heptane.

A methane-rich gas stream is removed as an overhead from the scrub column 28 in line 52. This overhead stream is at a temperature of −87° F. The overhead stream is directed to a compressor 54 which is driven by the expander 44. In this manner, the energy derived from reducing the pressure of the feed stream is preserved and utilized for the compression of product stream from the scrub column 28. The overhead stream is compressed from a pressure of approximately 725 psia at the inlet of the compressor to a pressure of 1037 psia at the exit of the compressor 54. At this point the overhead stream in line 56 is also at a temperature of −47° F.

The methane-rich stream which can contain appreciably heavier hydrocarbons despite partial removal in the scrub column 28, is now introduced into the main heat exchanger 60 where it is cooled, liquefied and subcooled in order to be removed and stored or transported as LNG or liquid natural gas. The methane-rich stream is first cooled in bundle 62 of a coil wound heat exchanger 60 utilizing preferably a multicomponent hydrocarbon refrigerant. This multicomponent hydrocarbon refrigerant constitutes a second closed circuit refrigeration system which operates at a low level because it must be at a sufficiently low temperature to liquefy and subcool natural gas. Such low level refrigeration is expensive to use because it requires a considerable power input to maintain the refrigerant at the low temperature necessary for liquefaction, −250° F. The stream is liquefied in this first bundle and is removed from the heat exchanger 60 to be expanded through valve 64 wherein the temperature of the stream is approximately −200° F. and is reduced in pressure to 300 psia. The liquid stream is then conducted through the second bundle 66 for further cooling against the multicomponent refrigerant wherein it exits the heat exchanger 60 in line 68 at approximately −250° F. and 270 psia. The stream is expanded through valve 70 in order to remove a small amount of vaporous methane in the phase separator 72 to provide plant fuel. Approximately 3% of the flow into vessel 72 is removed as plant fuel gas in line 80. The remaining stream is removed as product liquid from the bottom of vessel 72 and is pumped by pumping means 74 to storage 76. The product liquid natural gas can then be removed for export in line 78. Vapor phase methane which develops during storage of the natural gas product is removed and compressed by compressor 84 for inclusion as plant fuel. The main fuel stream in line 80 is warmed in heat exchanger 82 against multicomponent refrigerant. The combined plant fuel from line 80 and pump 84 is compressed in compressor 88 and exported in line 90 to power utilization for the plant.

The refrigerant for the liquefaction of the methane-rich stream consists of multiple hydrocarbon components, generally nitrogen, methane, ethane and propane. The specific multicomponent refrigerant utilized in this embodiment comprises ethane 47%, methane 41%, propane 8.9% and nitrogen 2.9%. Makeup multiple component refrigerant may be introduced into the liquefaction refrigeration cycle through line 198 which is controlled by a valve. Makeup refrigerant and recycle refrigerant in line 196 are compressed in compressor 152 and aftercooled in a cold water heat exchanger 154. A second level of compression is produced by compressor 156 and again is followed by aftercooling with cold water heat exchanger 158. This effects an increase in the pressure of the multicomponent refrigerant from 40 psia in line 196 at a temperature of approximately −40° F. to a pressure of 638 psia in line 160 at a temperature of approximately 54° F. The pressurized relatively warm multiple component refrigerant is then cooled in a cascade series of evaporative heat exchangers 162, 164 and 166 wherein the multiple component refrigerant is cooled against the single component refrigerant and the latter refrigerant is vaporized during the heat exchange. The multicomponent refrigerant as it exits the cascade heat exchangers in line 168 is at a pressure of approximately 620 psia and −30° F.

The multicomponent refrigerant is phase separated in vessel 170. Approximately 25% of the flow is removed as vapor in line 182 and the remaining 75% of the refrigerant flow is removed as liquid in line 172. The liquid refrigerant enters bundle tube circuit 176 of the main heat exchanger 60 and is cooled to −200° F. before being removed from the heat exchanger and reduced in pressure through valve 178. The reduced pressure liquid is then sprayed upon the lower tier of bundles in the heat exchanger 60 through spray head 180.

The vapor from the multicomponent refrigerant phase separator 170 is removed in line 182 and a slipstream is further removed from that stream in line 184. The bulk of the vapor phase refrigerant in line 182 is directed through line 188 into the warm end of the heat exchanger 60. The vaporized refrigerant is cooled and liquefied to approximately −250° F. in bundle tube circuit 190 before being removed and reduced in pressure through valve 192. The slipstream in line 184 is cooled and liquefied to a temperature of approximately −250° F. by heat exchange with the product fuel for the plant in intercooling heat exchanger 82 before being reduced in pressure through valve 186 and joining the vapor stream liquefied in the main heat exchanger 60. The co-mingled streams are then sprayed over the internal bundle of the heat exchanger through spray heads 194. The refrigerants are then recycled by removal from the bottom of the heat exchanger 60 in line 196. This multicomponent refrigerant which is used to liquefy the natural gas is cooled itself by a combination of heat exchange with the initial single component refrigeration cycle and the reduction in pressure which occurs in the main heat exchanger 60. The heat exchange against the single component refrigerant occurs in a cascade series of exchanges as outlined above. This refrigeration cycle for the initial single component refrigerant will now be set forth.

The single component refrigerant, which is preferably propane, is compressed in a series of stages in compressor 92 to a pressure of approximately 200 psia. The compressed single component refrigerant is then aftercooled and totally condensed in cold water heat exchangers 94 and 96 before being delivered to liquid reservoir 98. The liquid refrigerant is further subcooled in cold water heat exchanger 100 before being passed to refrigeration duty through line 102. The refrigerant is expanded through valve 104 and delivered to a supply-suction drum 108. The refrigerant in the vapor phase in drum 108 is removed for recompression in line 110. The liquid phase of the refrigerant in drum 108 is removed in line 118 and split into stream 120 which is split once again at line 122. The remaining stream in line 118 is expanded in valve 126 before being introduced into supply-suction drum 128. The split stream in line 122 is heat exchanged against the feed in evaporative heat exchanger 14. The residual stream in line 120 is heat exchanged in evaporative heat exchanger 162 against the second refrigeration system containing multiple component refrigerant. This is the first of three cascade refrigerating heat exchanges between the initial single component refrigerant and the second multicomponent refrigerant, both cycles of which are closed and are heat exchanged only indirectly in these exchangers. The vaporized single component refrigerant now in line 124 is mixed with the vaporized single component refrigerant introduced in line 122 and returned to the first supply-suction drum 108 through line 116.

The single component refrigerant in supply-suction drum 128 is separated into a vapor and liquid phase. The vapor phase is removed in line 130 for recompression in compressor 92. The liquid phase is removed in line 132 wherein the stream is split into line 134 and a residual stream which is expanded in valve 140 before being introduced into supply-suction drum 142. The liquid refrigerant stream in line 134 is further split into line 136 which cools the feed in the third cascade evaporative heat exchanger 16. The remaining stream in line 134 is used to cool the second refrigerant, consisting of a multicomponent refrigerant, in the second of a series of three cascade evaporative heat exchangers, specifically in this case exchanger 164. The now vaporized single component refrigerant in line 138 is mixed with the now vaporized refrigerant introduced in line 136 and returned to supply-suction drum 128.

The single component refrigerant delivered to supply-suction drum 142 through line 132 and valve 140 is also separated into a vapor phase and a liquid phase. The vapor phase is supplied to the compressor 92 for recompression through line 144. The liquid phase refrigerant is directed through line 146 for further heat exchange duty. A side stream 148 is removed wherein the refrigerant further cools the feed stream in evaporative heat exchanger 18 while being vaporized. The residual single component refrigerant in line 146 cools the second refrigeration circuit containing a multicomponent refrigerant in evaporative heat exchanger 166. In this manner, the single component refrigerant is used to cool the methane feed to the scrub column 28. The single component refrigerant is vaporized as it leaves exchangers 18 and 166 and the combined vapor streams are returned to supply-suction drum 142.

The process circuit of the present invention has several advantages over the prior art as set forth in U.S. Pat. No. 4,065,278. One of the most important advantages of the present invention is the reduction in the number of bundles in the main heat exchanger 60 from the three bundle configuration shown in the prior art patent including bundle 36 to a two bundle configuration as shown in FIG. 1A in heat exchanger 60 of the present application. Another advantage of the embodiment of FIG. 1A is that the entire feed is introduced into the column 28 at a point near the top of said column. This allows the single feed to supply all of the liquid reflux for the column.

The embodiment of FIG. 1A is specifically adapted for processing feedstock where little if any heavy hydrocarbon removal is desired or such hydrocarbons do not exist. When it is deemed necessary or profitable to process a feedstock having heavy hydrocarbons and the hydrocarbons are removed, the alternate embodiment of the process of FIG. 1A can be used in which additional processing advantages are realized. This alternate or second embodiment is shown in FIG. 1B.

Figure 1B:
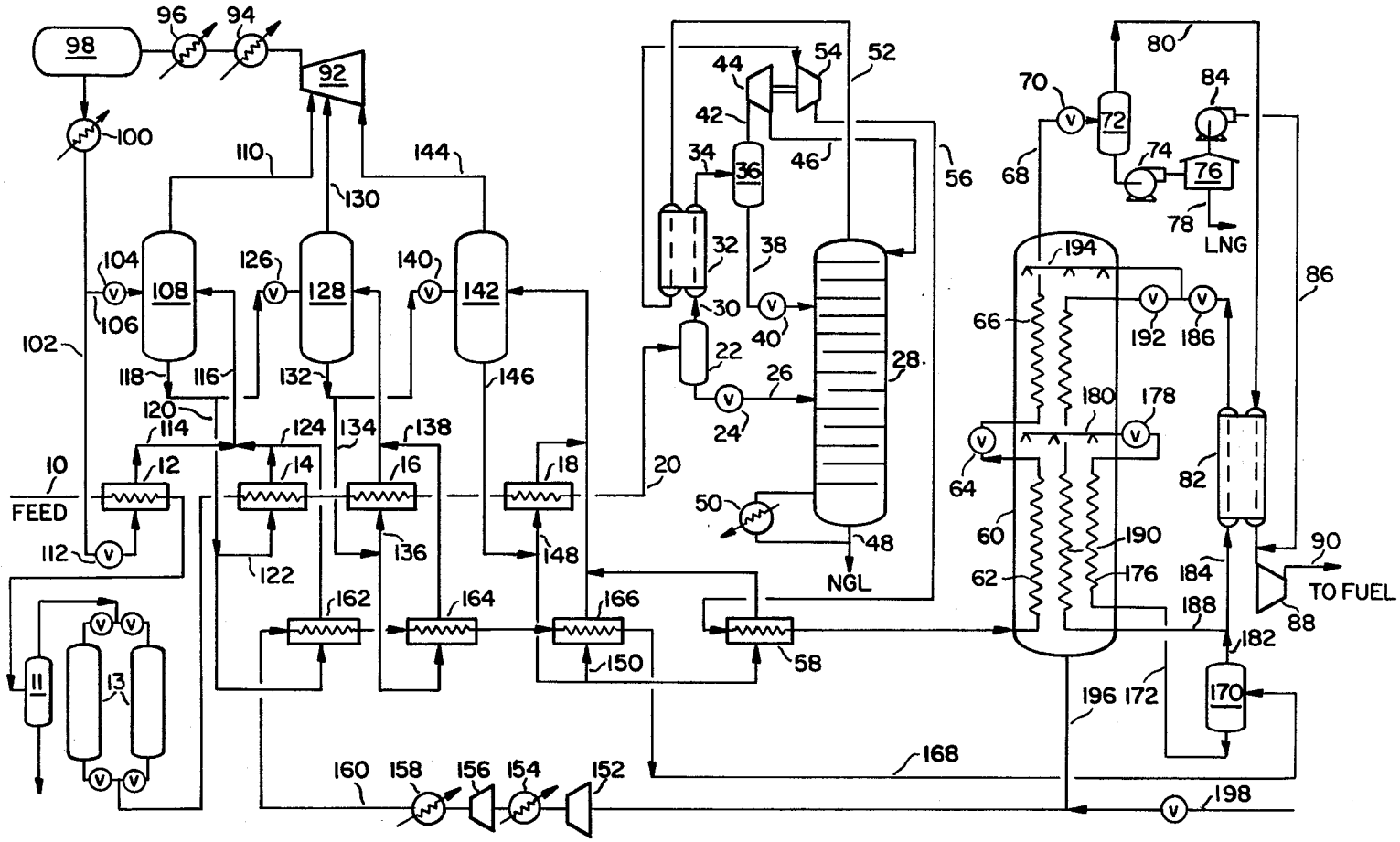
FIG. 1B is a schematic diagram of a second embodiment of the present invention for the utilization of a medium pressure natural gas stream.

With reference to FIG. 1B, the following preferred mode of operation is set forth. The process of FIG. 1B can operate on medium pressure feeds (600 to 1100 psia). Typically, a feed at 885 psia consists of methane 83%, ethane 10.5%, propane 3.7%, butane 1%, isobutane 0.65%, nitrogen 0.35% and trace amounts of higher hydrocarbons and water. FIG. 1B shows an initial separation of water from the feed in line 10, if this is necessary. Water separation is accomplished by cooling in heat exchanger 12 and then passage through a knock-out drum 11 and switching absorbent beds 13. Carbon dioxide can also be removed in such process treatment. The feed then passes through a similar precooling against a first refrigerant as described with respect to FIG. 1A. However, FIG. 1B is specifically designed for heavy hydrocarbon removal and the feed stream to the scrub column differs markedly from FIG. 1A for this purpose.

Because the feed natural gas is at a relatively medium pressure level, the feed may be phased separated several times before going to fractionation, which improves such fractionation processing. In that regard, the feed in line 20 is introduced into a phase separator 22 wherein the liquid phase, constituting 18.5% of the feed, is removed as a bottom stream in line 26 and reduced in pressure in valve 24 from 860 psi to 530 psi before being introduced into a scrub column 28 as liquid feed at −64° F. The vapor overhead from the vessel 22 is removed in line 30 wherein it is cooled in intercooling heat exchanger 32 to −65° F. with the overhead from said scrub column 28. The further cooled overhead in line 34 is introduced into a second phase separator 36. Again, the liquid phase, constituting 16% of the stream 34, is removed as a bottom stream in line 38 and expanded in valve 40 before being introduced as a second liquid feed stream into the scrub column 28 at −99° F. The vapor phase from the vessel 36 is introduced by way of line 42 into the expander turbine 44, where it is reduced in pressure while producing mechanical energy. The expanded feed containing vapor and liquid in line 46 is introduced into the top of the scrub column 28. These three separate feeds to the scrub column provide for improved efficiency in the fractionation of the methane-rich fraction from the heavier hydrocarbon fraction of the feedstock. A more substantial separation is performed in the scrub column 28 in the scheme of FIG. 1B than occurs in FIG. 1A. To achieve such a separation, it is necessary to drop the pressure of the feed to the column to a greater extent, and it is necessary to achieve a higher level of cooling of the feeds. Thus the phase separated feeds, the intercooling and the turbine expansion combine to provide the improved separation in column 28.

The overhead, in line 52, is introduced into the intercooling heat exchanger 32 in order to precool a portion of the feed to the scrub column 28 and to recover a portion of the refrigeration value of the overhead stream. The overhead stream leaves the heat exchanger 32 at approximately −40° F. and is directed to the compressor 54, which is driven by the expander 44. The compressed methane-rich stream is then cooled by heat exchange in evaporative heat exchanger 58 against the single component refrigerant of the first refrigeration circuit. The stream exits the heat exchanger 58 at −35° F.

The methane-rich stream from the exchanger 58 of FIG. 1B is then cooled, liquefied and subcooled as in the scheme illustrated in FIG. 1 and discussed above.

This second embodiment, FIG. 1B, also has the advantage of reducing the three bundle configuration of the prior art to a two bundle heat exchanger 60 with attendant cost savings. In addition, the second embodiment provides other advantages when NGL is being removed. The compressed overhead stream from the scrub column 28 in the present invention, after intercooling and expansion, is cooled in a simple evaporative heat exchanger 58 against high level (relatively warm) single component refrigerant rather than the more expensive low level (relatively cold) multicomponent refrigerant which also required an expensive third bundle fabrication in the main heat exchanger of the prior art. Another advantage of the present invention shown in FIG. 1B over the prior art is the heat exchange of the reflux feed to the scrub column against the methane-rich overhead stream from the column. This heat exchange which occurs in intercooler 32 provides a colder reflux feed to the column 28 and therefore a better fractionation. The refrigeration which occurs in exchanger 32 allows the exchanged feed to be split into two additional phases before going to the column 28. Therefore the embodiment in FIG. 1B of the present invention enjoys the advantage of three separate feeds to the distillation column, all introduced at their own appropriate level, such that initial fractionation is already occurring and the column can be operated at significant efficiency above and beyond that of the prior art. A further advantage of the present invention is the direct feed to the column of all of the separated streams from the phase separators. In the feeds to the column 28 in the prior art, the separated phases were rejoined to allow only one feed to the column. However, in the present embodiment shown in FIG. 1B, each phase separation is individually fed to the column.

These overall operating efficiencies and capital reductions of FIGS. 1A and 1B provide improved economic operation of a separation and liquefaction system for natural gas being converted to liquefied natural gas. Because of these improvements in the present invention over the process of the prior art, the present invention achieves an increase greater than 3% efficiency by reduced total compressor horse power requirements needed for operation for a similar capacity of production of LNG. In addition, the surface area of the main heat exchanger 60 of the present invention is reduced 41% from the prior art, such as U.S. Pat. No. 4,065,278. Such heat exchanger surface area is an important determination with respect to the cost of fabricating the apparatus for an LNG process. Therefore, with this surface area reduction, the present invention in the embodiment shown in FIG. 1 provides a main exchanger cost reduction of 47% over the stated prior art above.

The second embodiment discussed above is appropriate for what is termed medium pressure feeds, such as 600 to 1,100 psia. However, natural gas streams are available at 1,000 to 2,000 psia and are referred to herein as high pressure streams, such as those designated to be processed the first embodiment of FIG. 1A. Because these streams are available at such pressures, it is beneficial to process the streams at those pressures rather than losing the inherent energy of the high pressure in order to process the stream through a medium pressure system. Therefore, a second version of the second embodiment of the present invention will now be described with reference to FIG. 2, wherein the system is specifically designed for a high pressure feed stream and NGL recovery, that is a stream at 1,000 to 2,000 psia and preferably a stream at 1,600 psia with heavy hydrocarbons which are to be recovered. At these stated high pressures, phase separation in order to provide split feeds to the scrub column are not possible because the pressure of the system is above the critical pressure of the feedstock. A methane containing feedstock, such as natural gas, is introduced into line 200 at a temperature of 46° F. and a pressure of 1,624 psia. The stream flow is at a rate of 24,720 pound moles per hour consisting of 75% methane, 11.5% ethane, 8.5% propane, 2% butane, 1% isobutane and residual amounts of other $C_5$ to $C_7$ hydrocarbons. The feed stream in line 200 is initially cooled in a three step series of heat exchanges with a single component refrigerant in evaporative heat exchangers 202, 204 and 206. During this initial cooling, the feed stream is reduced in temperature to −34° F. The cooled stream now in line 208, is further cooled in intercooling heat exchanger 210 against the overhead stream from the scrub column 216. The intercooling between streams reduces the feed stream to a temperature of −59° F. The further cooled stream is then reduced in pressure by expanding the stream through an expander turbine 212 which further reduces the temperature to −94° F. and reduces the pressure of the stream to 600 psia. The feed stream is introduced into the scrub column 216 as its sole reflux stream. The column 216 operates at 600 psia and fractionates the methane-rich components of the feed stream from the heavier hydrocarbons, generally referred to as NGL or natural gas liquids. The NGL fraction is removed in line 218 wherein a portion of the NGL is recirculated by way of a heat exchanger 220. Approximately 21.4% of the feed to the column is removed in line 218, while 78.6% of the feed is removed as methane-rich product in line 222 as an overhead stream.

The overhead stream as stated above, is passed through an intercooling heat exchanger where it is warmed in order to cool the feed to the column. The overhead stream after warming in exchanger 210 is at a temperature of −40° F. in line 224. This methane-rich stream is then compressed in a compressor 226 which is mechanically joined to the expander 212 in order that the energy produced from expansion may be utilized efficiently in the recompression of the methane-rich gas stream. The compression of the methane-rich gas stream increases its temperature to −10° F. and increases its pressure to 747 psia. The methane-rich gas stream in line 228 is then cooled once more against the single component refrigerant in the first refrigeration cycle in evaporative heat exchanger 230 where the stream is reduced in temperature to −34° F. The stream is then introduced into the main heat exchanger 232 wherein it will be cooled, liquefied and subcooled to form liquefied natural gas or LNG.

The methane-rich stream in line 228 is introduced into the main heat exchanger 232 in the first stage bundle 234 wherein it is cooled and liquefied to −200° F. against a second multicomponent refrigerant in a second and separate refrigeration cycle from that of the first single component refrigeration cycle. The liquefied stream is then reduced in pressure by passage through a valve which expands the stream to a pressure of 300 psia before the stream is introduced into the second heat exchanger bundle 236 wherein the methane-rich stream is subcooled against additional multicomponent refrigerant and exits the main heat exchanger 232 at a temperature of −244° F. and a pressure of 270 psia. The subcooled stream is then reduced in pressure through an expander valve to a pressure of 18 psia and a temperature of −255° F. A two phase stream is produced by this expansion and the phases are separated in phase separator vessel 238. Approximately 95% of the stream is removed as liquid product from the bottom of vessel 238 and is pumped to storage 246 and export as LNG. Five percent of the stream is removed as an overhead vapor stream from vessel 238 in line 240. This vapor stream in line 240 is warmed against the multicomponent refrigerant in intercooling heat exchanger 242 before being combined with residual methane vapor from the LNG storage 246. This vapor from storage 246 is compressed and transported in line 248 to an intersection with the phase separated vapor in line 240 and is compressed in compressor 244 for use as fuel at the plant site or other adjacent utilities.

The refrigeration cycles of this second version are similar to those of the first embodiment, but several distinct variations will be noted in the discussion of those refrigeration cycles which follows. A multicomponent refrigerant consisting of predominently methane and ethane and lesser amounts of propane and nitrogen are used to liquefy the natural gas in the heat exchanger 232. This multicomponent refrigerant is recycled, but a portion of makeup refrigerant can be added just prior to the initial compression of the refrigerant in compressor 294. After the first stage of compression, the refrigerant is aftercooled against cold water and further compressed in compressor 296 with subsequent aftercooling against cold water to arrive at a pressure of 612 psia at 55° F. The multicomponent refrigerant is heat exchanged against the single component refrigerant in line 298 in a series of cascade heat exchangers 260, 276 and 290 wherein the multicomponent refrigerant is partially liquefied and cooled to a temperature of −34° F. The refrigerant is then phase separated in phase separator vessel 300, wherein 77% of the refrigerant is removed as a liquid stream in line 302 and 23% is removed in line 316 as a vapor phase. The liquid refrigerant enters main heat exchanger 232 in bundle tube circuit 306 wherein it is cooled to −200° F. before a portion of the refrigerant is split out and the remaining refrigerant is expanded in a valve in line 308, after which the refrigerant is sprayed over the warm bundle (first stage) of the heat exchanger 232 from spray nozzles in line 308. The split stream is expanded and provides refrigeration to the stream in line 314 in heat exchanger 310. This provides refrigeration for the fractionation of NGL in downstream equipment not deemed to be a part of the present invention. The multicomponent refrigerant now in line 312 is further expanded and rejoins the recycling refrigerant from the base of the heat exchanger 232.

A portion of the vaporous refrigerant from phase separator vessel 300 in line 318 is cooled through the entire course of the main heat exchanger 232, while the remaining portion of the vaporous refrigerant from the overhead of phase separator 300 in line 304 is cooled against vaporous LNG product in intercooling heat exchanger 242 before being expanded and rejoining the stream in line 318 to be introduced into the head of the exchanger 232 and sprayed on the cold bundle (second stage) of the main heat exchanger.

The single component refrigerant which initially cools the feed stream and also supplies a portion of the cooling for the second multicomponent refrigerant in evaporative heat exchangers 260, 276 and 290 is compressed in compressor 250 which consists of a three stage compressor. The single component refrigerant, which is preferably propane, is now at a pressure of 130 psia and a temperature of 105° F. The refrigerant is aftercooled and totally condensed in a series of cold water heat exchangers and supplied to a reservoir tank 252. Refrigerant is removed from the tank 252 and further cooled in a cold water heat exchanger before being expanded and supplied to the suction-supply drum 254. Liquid refrigerant is removed from the bottom of the drum 254 in line 258, a portion of which is directed in line 266 to a second suction-supply drum 268. The remaining refrigerant in line 258 is again split in order that a portion of the refrigerant will be used to cool the feed stream 200 in evaporative heat exchanger 202 before being returned to the drum 254 in line 264 as vapor. The last portion of the refrigerant in line 258 is used to cool the second multicomponent refrigerant in evaporative heat exchanger 260 before being returned in line 262 as vapor to be mixed with the vaporized refrigerant in line 264 and together returned to the drum 254. This vapor is then returned in line 256 for compression.

Similarly, a liquid propane refrigerant is removed from the base of drum 268 and is split into three streams, in which refrigerant in line 280 is supplied to a third suction-supply drum 282, a portion is utilized as a refrigerant in evaporative heat exchanger 204 and returned to drum 268 in line 278 while the remaining refrigerant in line 272 is directed in line 274 to further cool the second multicomponent refrigerant in evaporative heat exchanger 276 before the vapor is returned to line 278 and drum 268 to be collected and directed in line 270 for recompression. The refrigerant supplied in line 280 to suction-supply drum 282 is utilized in line 286 for refrigeration of the feed stream in evaporative heat exchanger 206 and also for refrigeration of the second, multicomponent refrigerant in evaporative heat exchanger 290 and aftercooling of the separated methane-rich stream from the scrub column 216 in heat exchanger 230. The vaporized refrigerants from these heat exchangers are collected in line 292 and returned to drum 282 wherein the vapor is removed from the overhead of the drum and supplied through line 284 to the compressor for combined recompression with the other vapor streams from the other drums.

This second high pressure version of the present invention provides improved production efficiencies over the prior art similar to the efficiencies calculated for the second embodiment shown in FIG. 1B and discussed above with respect to a medium pressure feed stream. The second version has the advantage of reduced capital costs with the reduction in the number of bundles in the main heat exchanger from the closest prior art, namely U.S. Pat. No. 4,065,278. This second version also has reduced overall compressor horse power requirements in comparison to the medium pressure prior art processes when adjustment is made for the fact that this embodiment operates on a high pressure feed, whereas the closest prior art operates on medium pressure feeds. For instance, the system illustrated in FIG. 2 has a 3.3% efficiency over U.S. Pat. No. 4,065,278. This reduction in horse power in conjunction with the reduction in capital costs of fabricating the main heat exchanger provides an attractive advantage of the present process over prior art processes for extracting NGL's and for liquefaction of natural gas streams.

Figure 2:
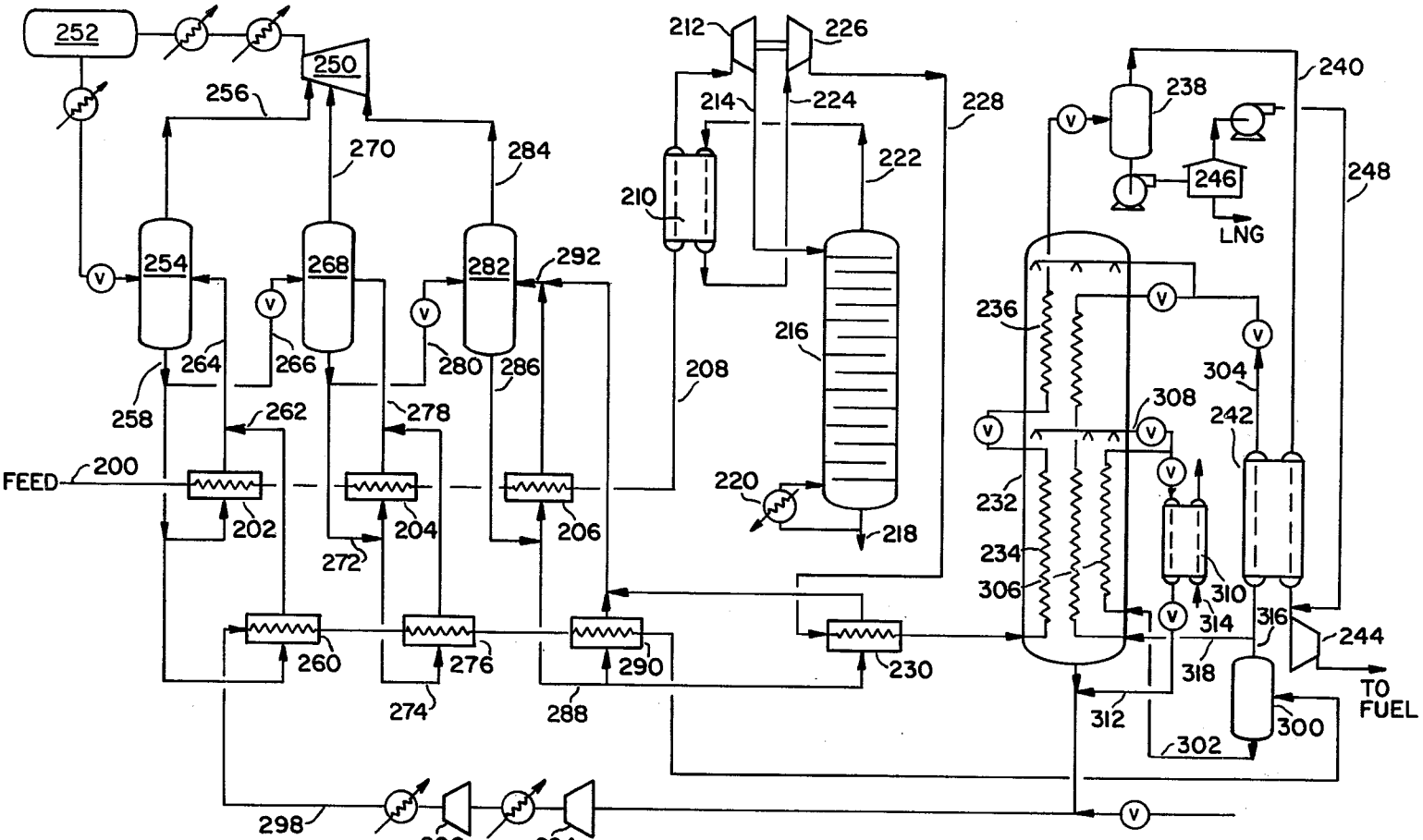
FIG. 2 is a schematic diagram of a second version of the second embodiment of the present invention for utilization with high pressure natural gas streams.
Figure 3:
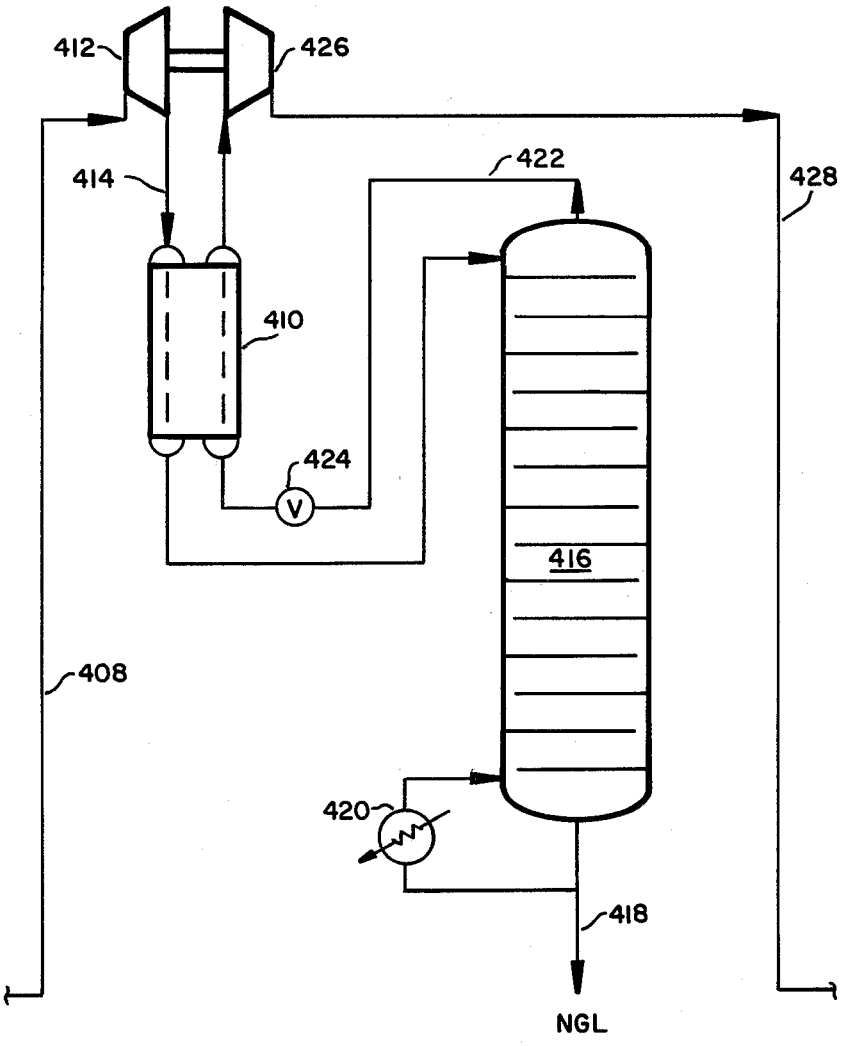
FIG. 3 is a partial schematic diagram taken from the flowscheme of FIG. 2 showing an alternate feed to the scrub column and an alternate exit from the column for high pressure natural gas streams.

An alternate embodiment for performing the separation of a high pressure natural gas feed such as was demonstrated in FIG. 2 above, is shown in FIG. 3. In this alternate embodiment, the precooling with a single component refrigerant is the same as in the second embodiment illustrated in FIG. 2 as well as the liquefaction processing downstream of the separation in the main heat exchanger. Therefore, this alternate embodiment is shown only in the feed to the scrub column 316 where the process variation from FIG. 2 exists.

In the flow scheme illustrated in FIG. 3, the feed natural gas at high pressure is initially cooled against a single component refrigerant in three cascade evaporative heat exchangers as shown in FIG. 2. The precooled feed in line 408 is at a temperature of −34° F. and a pressure of 1,600 psia. The feed is reduced in pressure by expansion through an expander 412, wherein the temperature is further reduced to −84° F. and the pressure is reduced to 600 psia. The expanded stream is then cooled by heat exchange with the overhead from the scrub column in a directly opposite sequence from that flow scheme illustrated in FIG. 2. The expanded stream in line 414 is cooled to −89° F. by heat exchange in the intercooling heat exchanger 410. The stream is then introduced into the scrub column 416 which operates at approximately 600 psia. Heavier hydrocarbons such as ethane, propane, butane and other multiple hydrocarbons are removed as natural gas liquids (NGL) in line 418. A portion of the stream is removed for recirculation through reboiling heat exchanger 420. A methane-rich stream is withdrawn from the scrub column 416 in line 422 as an overhead fraction containing 95% methane with residual portions of ethane and lesser amounts of other heavier hydrocarbons. This stream 422 is reduced in pressure through valve 424 to 450 psia with an attendent reduction in temperature to −105° F. The stream is warmed against the incoming feed to the column in the intercooling heat exchanger 410 and exits that exchanger at −91° F. The methane-rich stream is then compressed in compressor 426, which utilizes the mechanical energy derived from expansion in the expander 412. The pressure of the overhead stream 422 is then elevated to 627 psia by this compression before being sent to the main heat exchanger for cooling, liquefaction and subcooling to liquefied natural gas, LNG as described in FIG. 2 above.

This alternate embodiment shown in FIG. 3 achieves similar efficiencies for the separation of NGL's and the liquefaction of natural gas when compared against the prior art, such as U.S. Pat. No. 4,065,278. This embodiment utilizes the same two bundle liquefying heat exchanger with its attendant reduction in capital costs as described above. The FIG. 3 cycle also achieves greater cooling of the methane-rich stream coming from the overhead of the scrub column and therefore does not need the evaporative heat exchanger 230 shown in FIG. 2. Therefore with this greater reduction in temperature of the methane-rich stream in the embodiment shown in FIG. 3, capital cost may be saved over that flowpath shown in FIG. 2. This change in conjunction with the alteration in sequence of intercooling and expansion of the feed to the scrub column are the only distinctions between these two high pressure feed versions of the present invention as illustrated in FIG. 2 and FIG. 3.

The improved high pressure cycle shown in FIGS. 2 and 3 incorporate the same refrigeration recovery device consisting of an intercooling heat exchanger as shown in the medium pressure cycle of FIG. 1B. This refrigeration recovery is used to either further cool the expander outlet, FIG. 3, or to precool the expander inlet, FIG. 2. When it is used to cool the expander outlet, the scrub column overhead 422 must be reduced in pressure to provide a lower temperature and positive cold end temperature difference for the refrigeration recovery in heat exchanger 410. When the column overhead precools the expander inlet, FIG. 2, the resulting compressor outlet temperature in line 228 is somewhat warmer and thus the additional evaporative heat exchanger is used to recool the methane-rich feed to −34° F. prior to introduction into the main heat exchanger for liquefaction. This evaporative heat exchanger 230 was not required in the system of FIG. 3 since the compressor outlet stream in line 428 was cooled to −49° F., well below the lowest single component refrigerant temperature.

All of the cycles of the present invention illustrated in FIGS. 1, 2 and 3 provide improved processes which more effectively use the isentropically expanded feed gas to reflux a distillation or scrub column for recovery of $C_2$ plus hydrocarbons, thus eliminating the need for the use of more costly mixed refrigerant, which is at lower temperatures, to operate such a distillation column as is the case in the prior art, such as U.S. Pat. No. 4,065,278, wherein a third bundle 36 was necessary to reflux the column 28 using such expensive low level refrigeration.

The choice as to which process scheme to use is dependent on the feed stream pressure and the availability and desire to remove heavy hydrocarbons as NGL. A tradeoff does exist though. As processing circumstances vary, the scrub column of the various embodiments of the present invention can be operated at various pressures. At sufficiently high pressures, NGL recovery from the column is difficult and lesser amounts of NGL are actually separated. As the column pressure is reduced by expanding the feed to lower pressure, greater amounts of NGL recovery are capable. One of the consequences of this is that the methane-rich overhead from the column cannot be recompressed to as high a pressure without the use of outside energy requirements. This results in a higher power demand in the liquefaction and subcooling stage of the process because additional refrigeration power is required to liquefy a low pressure fluid. If NGL recovery is not required, then the scrub column may be designed to recover only sufficient $C_2$ and $C_3$ for refrigerant makeup. Heavy hydrocarbons such as benzene may also have to be removed to prevent freeze-up in the main exchanger. Both refrigerant recovery and heavies removal impose less load on the scrub column. Consequently, the scrub column may be operated at a higher pressure and temperature than required for NGL recovery. As less heavies need to be recovered, the scrub column may be operated at higher pressures resulting in the scrub column overhead being recompressed and returned to the main exchanger at higher pressure for liquefaction. At some point, as the scrub column pressure is increased to make lower heavies recovery, the maximum column pressure will be reached, which will be an approach to the fluid critical pressure (usually 80% of critical pressure). At this point, if heavies recovery is more than adequate, the expander feed/overhead interchanger may be reduced in duty until it is eliminated.

The direct feed of the methane-rich feed stream from an expander to the top of a scrub column, and the elimination of the requirements for reflux for the column from the main liquefying heat exchanger with its attendant reduction in heat exchanger costs is an integral part of the benefits of the present invention. Suoh an adaptation to an LNG plant can be contemplated on other natural gas or methane liquefaction systems, such as disclosed in U.S. Pat. Nos. 3,645,106; 4,112,700; 4,251,247 and 4,274,849, the texts of which are incorporated herein by reference.

The prior art in performing the liquefaction of a methane-rich feedstock with heavy hydrocarbon recovery for either refrigerant or as product has utilized various sources of refrigeration for the production of liquid feed or reflux to the scrub column which removes the heavy hydrocarbons prior to liquefaction of the methane-rich portion of the feed. Initially, such scrub column reflux was developed by heat exchange with high level refrigeration, high level refrigeration being the relatively warmer refrigeration which initially cools the feed material prior to separation or liquefaction and represented by the first refrigerant which is circulated through compressor 92 of FIGS. 1A and B of the present invention. This increase in load on the high level refrigeration increases the energy requirements for that refrigeration cycle substantially. Subsequently, scrub column reflux was developed by heat exchange with both high level refrigeration and low level refrigeration, low level refrigeration being the refrigerant of relatively cold temperature which performs the liquefaction and subcooling of methane-rich gas, such as the second refrigerant which is circulated through compressors 152 and 156 of FIGS. 1A and B of the present invention. The use of low level refrigeration is relatively energy-intensive and expensive because of its low temperature level. To diminish the refrigeration load made by the liquid feed as reflux to the scrub column, prior art U.S. Pat. No. 4,065,278 contemplated using high level and low level refrigeration in conjunction with a tandem expander and compressor unit, which are mechanically joined to use the energy of expansion for subsequent compression, to provide the refrigeration power for the scrub column. However, the use of expensive low level refrigeration was still required, and its use additionally required expensive capital investment in a tubing bundle, such as 36 of U.S. Pat. No. 4,065,278, in the main heat exchanger.

The present invention, in all of its embodiments, eliminates the need for low level refrigeration from the low level refrigeration circuit for cooling of the column feed and reduces the main heat exchanger cost by eliminating a tubing bundle. This is accomplished by expanding the high level refrigerant precooled feed and delivering it directly to the top of the scrub column to provide all of the liquid or reflux necessary in the column for the desired amount of separation of heavy hydrocarbons from methane in methane-containing feed streams. The expansion is energy efficient because the energy provided by the expansion is recovered in the compressor which recompresses the methane-rich overhead for efficient liquefaction of the methane against low level refrigeration. It is contemplated that any of the methane liquefaction processes set forth in the patents identified above should benefit and be more energy efficient with the improvement constituting the present invention.

The present invention can accommodate a number of variations as evidenced by the alternate flow schemes in FIG. 2 and FIG. 3. Therefore, the scope of the invention should not be limited by the specific embodiments set forth above, but rather by the claims which follow.

What is claimed is:

1. In a liquefaction process for natural gas wherein heavy hydrocarbons can be separated and recovered in which the natural gas is initially cooled against a first, high level refrigerant before being passed to a scrub column for separation of at least some heavy hydrocarbons and is then subsequently cooled, liquefied and subcooled against a second, low level refrigerant in a main heat exchanger, the improvement comprising providing liquid reflux to the scrub column by expanding the precooled natural gas feed isentropically while obtaining mechanical energy and delivering the expanded feed to the top of said scrub column as a feed and as all of the reflux to said column while removing a methane-rich overhead from said column and recompressing it in a compressor driven by said expander and delivering the recompressed methane-rich overhead stream directly to the main heat exchanger for liquefaction as product.

2. A liquefaction process for natural gas including the separation in a scrub column of heavier hydrocarbons as a bottom stream from a methane-rich fraction as an overhead stream, comprising the steps of:

(a) introducing a natural gas feed stream into the liquefaction system at a pressure in the range of 600–2000 psia;

(b) cooling the feed stream in a series of heat exchangers in indirect heat exchange with a first refrigerant in a closed refrigeration system;

(c) reducing the pressure of the feed stream to a pressure which is below the critical pressure of both the overhead and bottom streams by isentropically expanding said feed stream while obtaining mechanical energy;

(d) introducing the expanded feed stream as feed and as all of the reflux to the scrub column to separate the methane-rich fraction as an overhead stream;

(e) compressing the overhead stream to a high pressure in a compressor utilizing the mechanical energy derived from the expansion of step (c);

(f) cooling, liquefying and subcooling the methane-rich stream in a heat exchanger by indirect heat exchange with a second, multi-component, refrigerant in a closed refrigeration system;

(g) withdrawing said liquefied and subcooled methane-rich stream as an LNG product.

3. A liquefaction process for natural gas including the separation in a scrub column of heavier hydrocarbons as a bottom stream from a methane-rich fraction as an overhead stream, comprising the steps of:

(a) introducing a natural gas feed stream into the liquefaction system at a pressure in the range of 600–2000 psia;

(b) cooling the feed stream in a series of heat exchangers in indirect heat exchange with a first refrigerant in a closed refrigeration system;

(c) reducing the pressure of the feed stream to a pressure which is below the critical pressure of both the overhead and bottom streams by a combination of isentropically expanding said feed stream while obtaining mechanical energy and intercooling at least a portion of the feed stream against the methane-rich overhead stream from the scrub column;

(d) introducing the intercooled and expanded feed stream as feed and as all of the reflux to the scrub column to separate the methane-rich fraction as an overhead stream and the heavier hydrocarbon fraction as a bottom stream;

(e) warming the methane-rich overhead stream in an intercooling heat exchange against the intercooling feed stream of step (c);

(f) compressing the warmed overhead stream to a high pressure in a compressor utilizing the mechanical energy derived from the expansion of step (c);

(g) cooling, liquefying and subcooling the methane-rich stream in a heat exchanger by indirect heat exchange with a second, multi-component, refrigerant in a closed refrigeration system;

(h) withdrawing said liquefied and sub-cooled methane-rich stream as an LNG product.

4. The invention of claim 3 wherein a medium pressure natural gas feed stream at 600–1100 psia is processed in which, after the initial cooling, the feed is phase separated to remove a liquid bottom stream which is introduced to the scrub column as intermediate feed and a gaseous overhead stream which is intercooled against the methane-rich overhead stream and further phase separated wherein the liquid phase is again introduced as an intermediate feed to the scrub column and the gaseous phase is expanded isentropically with the production of mechanical energy before being introduced into the scrub column as reflux, and the methane-rich overhead stream from the scrub column, after compression, is cooled by indirect heat exchange with the first refrigerant before being liquefied and subcooled to LNG by heat exchange with the second refrigerant.

5. The invention of claim 3 wherein a high pressure natural gas feed stream at 1000 to 2000 psia is processed in which after the initial cooling, the feed is isentropically expanded with the production of mechanical energy and then intercooled against the methane-rich overhead stream before the feed is introduced as reflux to the scrub column.

6. The invention of claim 3 wherein a high pressure natural gas feed stream at 1000 to 2000 psia is processed in which after the initial cooling, the feed is intercooled by heat exchange against the methane-rich overhead stream before being isentropically expanded and said methane-rich overhead stream, after compression, is cooled by indirect heat exchange with the first refrigerant before being further cooled, liquefied and subcooled by heat exchange against the second refrigerant.

7. The invention of claims 3, 4, 5 or 6 wherein the liquefied product of step (g) is phase separated to produce a liquid bottom stream for delivery as LNG product for storage and a gaseous overhead which is warmed by indirect heat exchange with the second refrigerant to recover refrigeration value from the gaseous overhead before said overhead is used as a plant fuel.

* * * * *